US010590731B2

(12) United States Patent
Clemens et al.

(10) Patent No.: US 10,590,731 B2
(45) Date of Patent: Mar. 17, 2020

(54) RETRIEVAL OF A SEALING ASSEMBLY

(71) Applicant: HALLIBURTON ENERGY SERVICES, INC., Houston, TX (US)

(72) Inventors: Jack Gammill Clemens, Fairview, TX (US); Anthony Phan, Lewisville, TX (US); Mark Holly, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 279 days.

(21) Appl. No.: 15/718,928

(22) Filed: Sep. 28, 2017

(65) Prior Publication Data

US 2019/0093447 A1 Mar. 28, 2019

(51) Int. Cl.
*E21B 33/12* (2006.01)
*E21B 33/128* (2006.01)
*E21B 23/06* (2006.01)

(52) U.S. Cl.
CPC ..... *E21B 33/128* (2013.01); *E21B 23/06* (2013.01); *E21B 33/1208* (2013.01)

(58) Field of Classification Search
CPC ..... E21B 23/06; E21B 33/1208; E21B 33/128
See application file for complete search history.

(56) References Cited

U.S. PATENT DOCUMENTS 3,706,342 A * 12/1972 Woolley ..... E21B 23/06 277/340
4,554,973 A * 11/1985 Shonrock ..... E21B 33/1216 166/192
5,158,137 A * 10/1992 Kim ..... E21B 33/02 166/191
5,904,354 A 5/1999 Collins
6,318,461 B1 * 11/2001 Carisella ..... E21B 33/1216 166/135
6,902,008 B2 * 6/2005 Hirth ..... E21B 33/128 166/387
7,134,506 B2 11/2006 Moyes
7,178,602 B2 * 2/2007 Hiorth ..... E21B 33/1216 166/118

(Continued)

OTHER PUBLICATIONS

Chapman et al., "Wireline Deployed Metal Sealing Bridge Plug System", Abstract retrieved from the internet at https://www.onepetro.org/conference-paper/SPE-113891-MS, 2008, 2 pages.

*Primary Examiner* — Daniel P Stephenson
(74) *Attorney, Agent, or Firm* — Kilpatrick Townsend & Stockton LLP

(57) ABSTRACT

Assemblies and methods are provided for retrieving a sealing assembly from within a tubing string positioned downhole in a wellbore. The sealing assembly may include a plug that may include a non-elastomeric material at least partially surrounding an elastomeric material. The sealing assembly may be run downhole in the wellbore with the plug at an original diameter. The sealing assembly may be set such that the plug is expanded to a set diameter. The retrieval tool may be coupled to the sealing assembly and may be extended in a first direction. The extension of the retrieval tool may lengthen the sealing assembly. The lengthening of the sealing assembly may extend the length of the plug and may thereby reduce the diameter of the plug. In some aspects, the retrieval tool may reduce the diameter of the plug back to the original diameter.

20 Claims, 6 Drawing Sheets

(56) References Cited

U.S. PATENT DOCUMENTS

| | | | | |
|---|---|---|---|---|
| 8,267,177 | B1 * | 9/2012 | Vogel | E21B 33/1294 166/131 |
| 8,393,388 | B2 * | 3/2013 | Bishop | E21B 33/128 166/119 |
| 8,403,035 | B2 * | 3/2013 | Akselberg | E21B 33/128 166/118 |
| 8,555,959 | B2 * | 10/2013 | Clemens | E21B 23/01 166/134 |
| 8,555,986 | B2 * | 10/2013 | Clemens | E21B 23/01 166/382 |
| 8,701,787 | B2 * | 4/2014 | Shkurti | E21B 33/1216 166/134 |
| 8,714,270 | B2 * | 5/2014 | Clemens | E21B 23/01 166/206 |
| 9,051,812 | B2 * | 6/2015 | Clemens | E21B 23/01 |
| 9,085,968 | B2 | 7/2015 | Xu et al. | |
| 2007/0235191 | A1 | 10/2007 | Loughlin et al. | |
| 2017/0138150 | A1 * | 5/2017 | Yencho | E21B 43/116 |
| 2019/0093447 | A1 * | 3/2019 | Clemens | E21B 33/1208 |

* cited by examiner

RETRIEVAL OF A SEALING ASSEMBLY

TECHNICAL FIELD

The present disclosure relates generally to devices for use in a wellbore in a subterranean formation and, more particularly (although not necessarily exclusively), to tools for retrieving sealing assemblies.

BACKGROUND

Various devices can be utilized in a well traversing a hydrocarbon-bearing subterranean formation. For example, a sealing assembly such as a retrievable bridge plug may be installed or set along tubing string in the well. A plug of the sealing assembly may include an elastomeric material and a non-elastomeric material, for example but not limited to a metal material. The non-elastomeric material may at least partially surround the elastomeric material of the sealing assembly. A force, for example a pressure, may be applied to the sealing assembly that forces the elastomeric material and the non-elastomeric material to deform and expand. Expansion of the elastomeric material and the non-elastomeric material may increase the diameter of the sealing assembly and may restrict the flow of fluid through an annulus between the sealing assembly and the tubing. The sealing assembly may also be retrieved from within the tubing and returned to the surface of the well. The elastomeric material may more easily return to a smaller diameter after expansion more easily than the non-elastomeric material. A smaller diameter of the sealing assembly may improve the ease return of the sealing assembly to the surface through restrictions in the tubing string.

DETAILED DESCRIPTION

Figure 1:
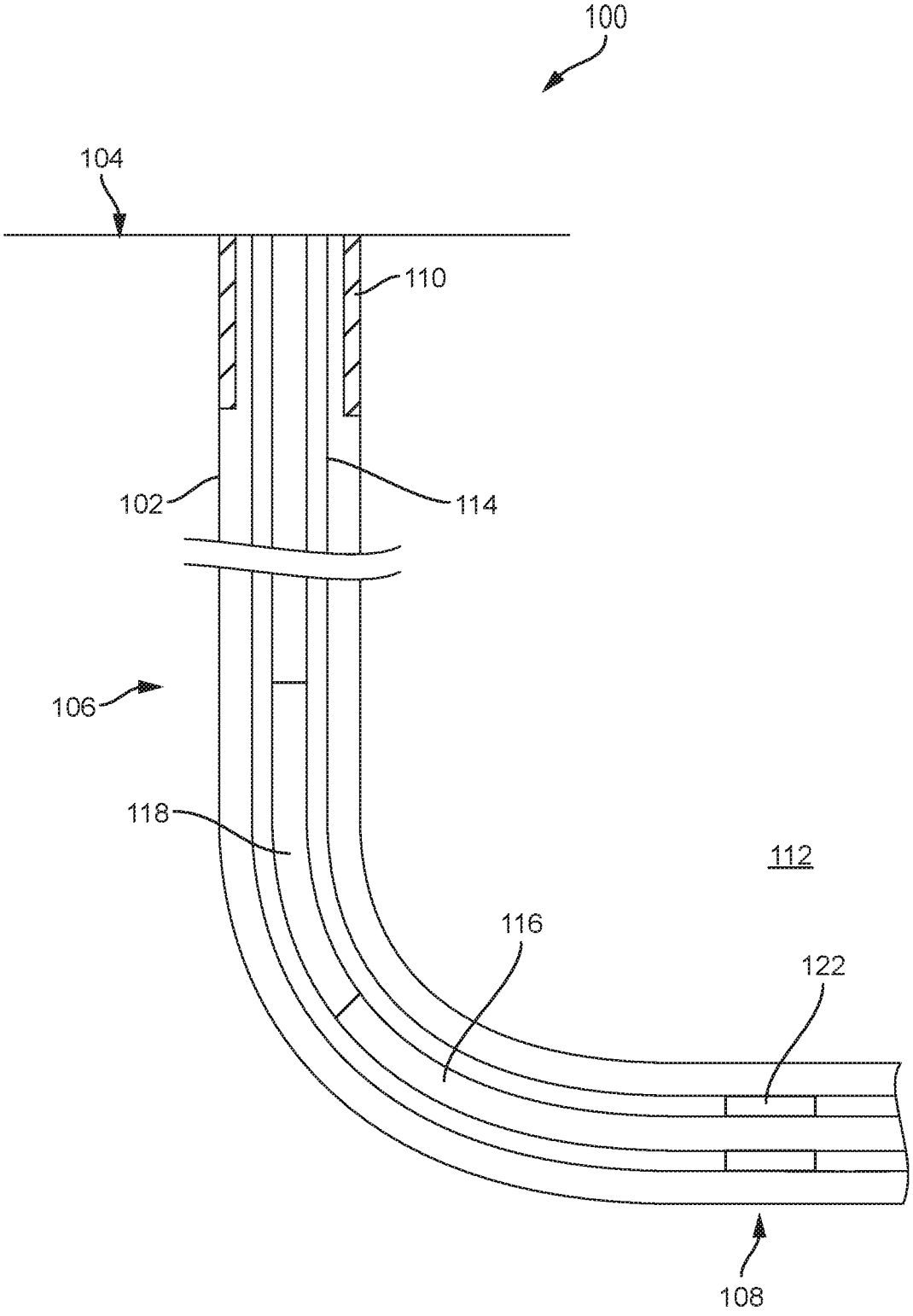
FIG. 1 is a cross-sectional view of a well system with a tool assembly coupled to a sealing assembly, according to one aspect.

Certain aspects and features of the present disclosure relate to a tool assembly and methods for retrieving a sealing assembly, for example but not limited to a retrievable bridge plug, in a tubing string of a well system using the tool assembly. In some aspects, the sealing assembly may include a non-elastomeric sealing surface that contacts an inner surface of the tubing string for creating, for example a metal-to-metal seal when the sealing assembly is set (or expanded). In the set position the sealing assembly may have an outer diameter that is greater than the original outer diameter of the sealing assembly prior to expansion (i.e. in the run-in-hole set position). The tool assembly may be a retrieval tool that may return the sealing assembly to a diameter that is less than the diameter in the run-in-hole position. In some aspects, the retrieval tool may return the sealing assembly to a diameter that is substantially equal to the diameter at the run-in-hole position also be used to return the sealing assembly back to the original (or run-in-hole) diameter.

In some aspects, the sealing assembly may include a plug, or other suitable sealing element. The plug or other sealing element may include an elastomeric material and a non-elastomeric material. The non-elastomeric material may include a metal material, though other suitable materials may be used. The non-elastomeric material may extend around the elastomeric material for contacting the inner surface of the tubing string when the sealing assembly is expanded in the set position. In some aspects, the non-elastomeric material may be a metal material for forming a metal-to-metal seal between the sealing assembly and the tubing string in which it is expanded may be a stronger seal than that formed between an elastomeric material and the inner surface of the tubing string. The metal-to-metal seal may also prevent or reduce the elastomeric material extruding. A stronger seal may be desirable to withstand increased pressures within the well system. The sealing assembly may be unset to return to a smaller diameter than the diameter in the set position. In some aspects, the sealing assembly may be returned to the original diameter. The smaller the diameter the sealing assembly is returned to, the easier it may be to return the sealing assembly to the surface through the tubing assembly. For example, the tubing assembly may include narrow passageways or restrictions and the smaller the diameter of the sealing assembly the easier it may be to return the sealing assembly to the surface. The elastomeric material of the plug may have shape memory and may more easily return to the original diameter than the non-elastomeric material (e.g., metal material) of the sealing assembly. The elastomeric material may also support the non-elastomeric material and may aid in preventing the collapse of the non-elastomeric material when the plug is in the set position.

A retrieval tool may couple to the sealing assembly for returning the sealing assembly to the surface. The retrieval tool may elongate (or lengthen) and may force the sealing assembly to elongate. The elongation of the sealing assembly may also lengthen the plug (or sealing element) and thereby reduce the diameter of the plug. The elongation of the plug may aid in returning the non-elastomeric material to a smaller diameter than the set diameter, in some aspects the elongation of the retrieval tool may cause the non-elastomeric material to return to its original (run-in-hole) diameter.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts by cross-section an example of a well system 100 that includes a bore that is a wellbore 102 extending through a surface 104 and various earth strata. The wellbore 102 has a substantially vertical section 106 and a substantially horizontal section 108. The substantially vertical section 106 and the substantially horizontal section 108 may include a casing string 110 cemented at an upper portion of the substantially vertical section 106. The substantially horizontal section 108 extends through a hydrocarbon bearing subterranean formation 112. A tubing string 114 within wellbore 102 extends from the surface to the subterranean formation 112.

A sealing assembly, for example a plug assembly 116 can be deployed in the wellbore 102. In some aspects, the plug assembly 116 may be a retrievable bridge plug, though any suitable sealing assemblies may be used. The plug assembly 116 may be set within the tubing string 114 to isolate a portion of the wellbore 102 below the plug assembly 116 from a portion of the wellbore 102 above plug assembly 116. The plug assembly may be set by a tool assembly, for example by applying a pressure to the plug assembly that forces a plug 122 of the plug assembly 116 to expand. The plug assembly 116 may also be retrieved from within the tubing string 114 and returned to the surface 104.

A retrieval tool 118 may be used to retrieve the plug assembly 116 from the tubing string 114 and return the plug assembly 116 to the surface 104 of the well system 100. In some aspects, the retrieval tool 118 may also be used to set the plug assembly 116. Although FIG. 1 depicts the plug assembly 116 and retrieval tool 118 in the substantially horizontal section 108, the plug assembly 116 and retrieval tool 118 can be located, additionally or alternatively, in the substantially vertical section 106. The plug assembly 116 may also be deployed in open-hole environments or in cased wells.

Figure 2:
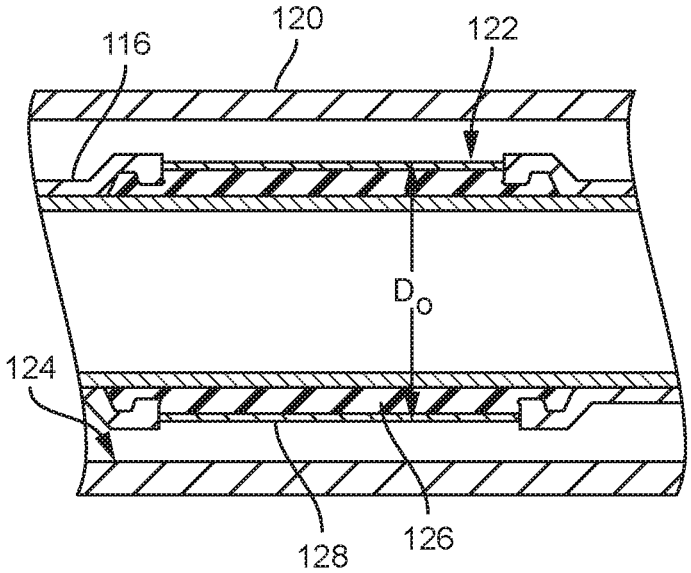
FIG. 2 is a cross-sectional side view of a seal assembly in a run-in-hole position, according to one aspect.

FIG. 2 is a lateral cross-sectional view of a sealing assembly, for example plug assembly 116 within a tubing string 120. The plug assembly 116 may include a plug 122. The plug assembly 116 is shown in FIG. 2 in a run-in-hole position. As shown in FIG. 2, in the run-in-hole position the plug 122 has a diameter $D_o$ and the plug 122 does not contact an inner surface 124 of the tubing string 120. The plug 122 may include an elastomeric material 126 and a non-elastomeric material, for example a metal material 128. The metal material 128 may at least partially surround the elastomeric material 126. In some aspects, the metal material 128 may fully surround the elastomeric material 126. As the metal material 128 surrounds the elastomeric material 126, the run-in-hole diameter $D_o$ of the plug 122 corresponds to the run-in-hole diameter of the metal material 128. The inner surface 124 of the tubing string 120 may comprise metal, thus forming a metal-to-metal seal between the metal material 128 of the plug 122 and the inner surface 124 of the tubing string 120. A metal-to-metal seal may be a stronger seal than a seal formed between metal and an elastomeric material. For example, a metal-to-metal seal may be able to withstand a higher pressure without movement or failing as compared to a seal between an elastomeric material and the inner surface 124 of the tubing string 120.

To set the plug 122 of the plug assembly 116 a downhole tool may apply a force to the plug assembly 116. The force may be a pressure or a compressive force. The force may compress the plug assembly 116 and may force the plug 122 to compress and expand to a set position (shown in FIG. 3).

Figure 3:
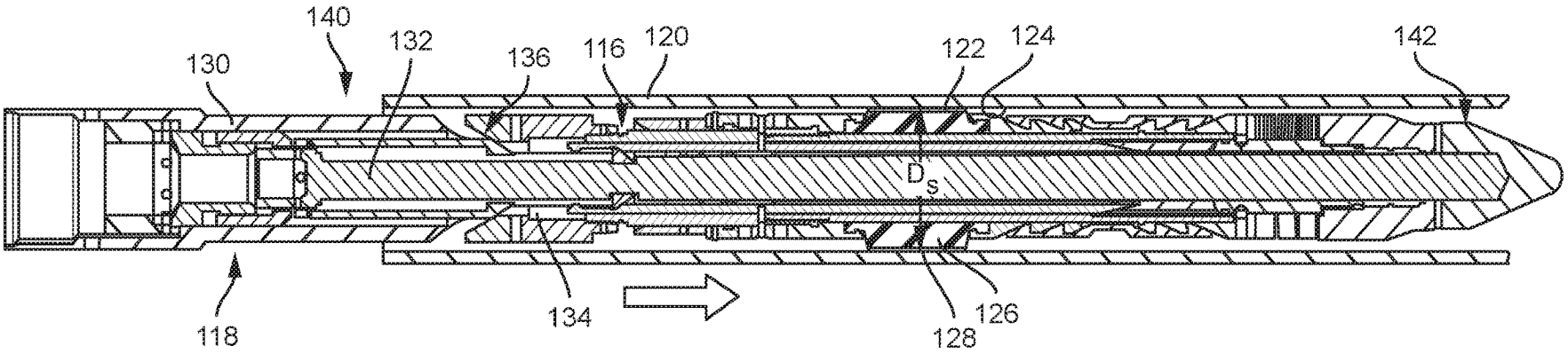
FIG. 3 is a cross-sectional side view of a tool assembly coupled to the seal assembly of FIG. 2 in the set position, according to one aspect.

FIG. 3 is a lateral cross-sectional view of the retrieval tool 118 coupled to the plug assembly 116, the plug assembly 116 is shown in the set position. The plug 122 has a diameter of $D_s$ in the set position. The set diameter $D_s$ of the plug 122 may correspond to the set diameter of the metal material 128. In the set position, the plug 122 contacts and is sealed against the inner surface 124 of the tubing string 120. The plug 122 may remain in the set position for a desired period of time.

It may be desirable to retrieve or return the plug assembly 116 to the surface. To return the plug assembly 116 to the surface, the plug assembly 116 may have to pass through restrictions in the tubing string 120 or other tubing strings through which the plug assembly 116 passes on its path back to the surface. It may be easier to return the plug assembly 116 to the surface, past the restrictions in various tubing strings, when the diameter of the plug 122 is reduced to a diameter that is smaller than its set diameter $D_s$. For example, the diameter of the plug 122 may be reduced or returned back to the run-in-hole diameter $D_o$. In some aspects, the elastomeric material 126 may more easily reduce to a smaller diameter, for example the run-in-hole diameter, based on the memory and characteristics of the elastomeric material 126. The metal material 128 may not have the same memory and characteristics of the elastomeric material 126.

A downhole tool, for example the retrieval tool 118 may be used to reduce the diameter of the plug 122 and return the plug assembly 116 to the surface. As shown in FIG. 3, the retrieval tool 118 may be coupled to the plug assembly 116 within the tubing string 120. The retrieval tool 118 may include a housing 130 that may be coupled to a housing of a down-hole power unit (DPU, not shown). The retrieval tool 118 may include a rod 132 that extends from the housing 130. The rod 132 may also couple to the DPU. The rod 132 may be received within an inner region 134 of the plug assembly 116. The rod 132 may be extended or lengthened in a first direction (shown by an arrow in FIG. 3). The retrieval tool 118 may also include a mechanical latch device, for example a collet 136 that couples to an inner surface 138 of the plug assembly 116.

The rod 132 may extend from a first end 140 to a second end 142 of the plug assembly 116. The retrieval tool 118 may be powered or controlled by the DPU. For example, the DPU may force the rod 132 in the first direction. In some aspects, the retrieval tool 118 may also be used to set or expand the plug 122 from the run-in-hole position (shown in FIG. 2) to a set position in which the plug 122 is expanded and set in place against the inner surface 124 of the tubing string 120 (shown in FIG. 3).

The retrieval tool 118 may reduce the diameter of the plug assembly 116 by reducing the diameter of the plug 122. In some aspects, the retrieval tool 118 may return the plug 122 to the run-in-hole diameter $D_o$. In some aspects, the retrieval tool 118 may return the plug 122 to a diameter that is smaller than the set diameter $D_s$ and that is substantially equal to the run-in-hole diameter $D_o$. In some aspects, the retrieval tool 118 may return the plug 122 to a diameter that is between 3% and 30% larger than the run-in-hole diameter $D_o$, for example between 5% and 20% larger than the run-in-hole diameter $D_o$, between 7% and 15% larger than the run-in-hole diameter $D_o$, or between 10% and 12% larger than the run-in-hole diameter $D_o$. As shown in FIG. 3, the diameter of the metal material 128 may correspond to the diameter of the plug 122. The smaller the diameter of the plug 122 the easier the return of the plug assembly 116 to the surface may be.

To reduce the diameter of the plug 122, the rod 132 of the retrieval tool 118 may elongate or lengthen in the first direction (shown by the arrow in FIG. 3). In some aspects, the first direction may be in a downhole direction. As the rod 132 extends in the first direction, the plug assembly 116 may be held in place proximate to the first end 140 rod 132 proximate to the plug 122 by the collet 136. The plug assembly 116 may be coupled to the rod 132 proximate to the second end 142 of the rod 132. As the rod 132 is moved in the first direction, the plug assembly 116, including the plug 122, may be forced in the first direction by the movement of the rod 132. The movement of the rod 132 pulling the plug 122 in the first direction may stretch or lengthen the plug assembly 116. As the plug assembly 116 lengthens, the plug 122 may also be extended or lengthened, for example the metal material 128 of the plug 122 may elongate or lengthen. The lengthening of the metal material 128 and elastomeric material 126 of the plug 122 may result in the diameter of the plug 122 being reduced. For example, as the metal material 128 elongates, the metal material 128 may return to a diameter that is less than the set diameter $D_s$. In some aspects, the metal material 128 to return to the run-in-hole diameter $D_o$, or a diameter that is substantially equal to the run-in-hole diameter (as described above). The elastomeric material 126 may also return to a diameter that is less than the set diameter $D_s$, for example it may return to the run-in-hole diameter $D_o$.

Figure 4:
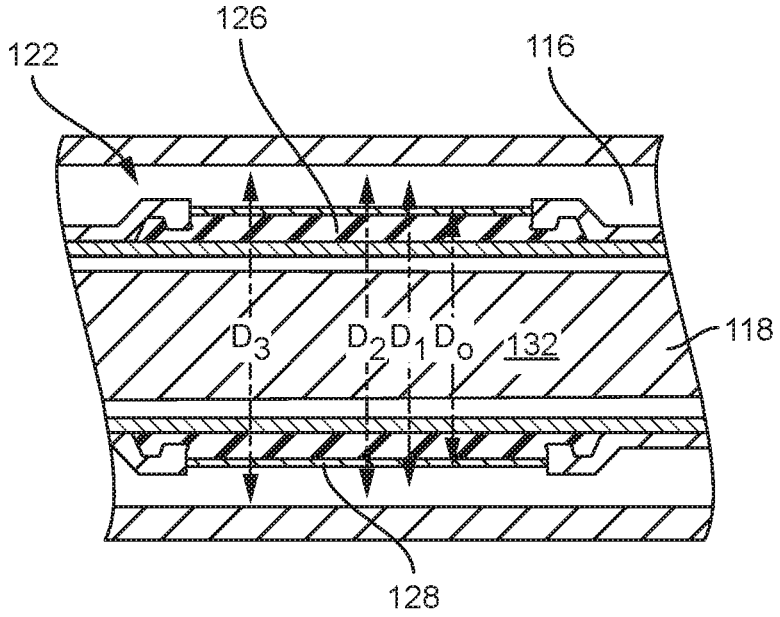
FIG. 4 is a cross-sectional side view of the tool assembly coupled to the seal assembly of FIGS. 2 and 3 in an unset position, according to one aspect.

FIG. 4 is a lateral cross-sectional view of the retrieval tool 118 and the plug 122 of the plug assembly 116, with the plug 122 in an unset position, returned to a smaller diameter than the set diameter Ds. In some aspects, such as in the aspect shown in FIG. 4, the plug 122 may be returned to the run-in-hole diameter $D_o$ following the elongation of the rod 132 in the first direction. FIG. 4 depicts other potential diameters to which the plug 122 may be returned in dotted lines. For example, the plug 122 may be returned to a diameter $D_1$ that is 5% greater than the original diameter, a diameter $D_2$ that is 10% greater than the original diameter, or a diameter $D_3$ that is 15% greater than the original diameter $D_o$. In some aspects, the plug 122 may return to a diameter that is between 1% and 30% greater than the original diameter, though in still yet other aspects the plug 122 may return to another diameter less than the set diameter Ds. In the aspect shown in FIG. 4, the metal material 128 of the plug 122 has returned to the run-in-hole diameter $D_o$, as has the elastomeric material 126. Thus, the plug 122 has returned to the run-in-hole diameter $D_o$. In some aspects, the plug 122 may return to a diameter that is less than the set diameter $D_s$ and that is substantially equal to the run-in-hole diameter $D_o$, including but not limited to a diameter that is between about 5% and about 30% larger than the run-in-hole diameter $D_o$. The plug assembly 116 may be retrieved through the tubing string 120 and returned to the surface at the smaller diameter, in some aspects the run-in-hole diameter $D_o$.

Figure 5:
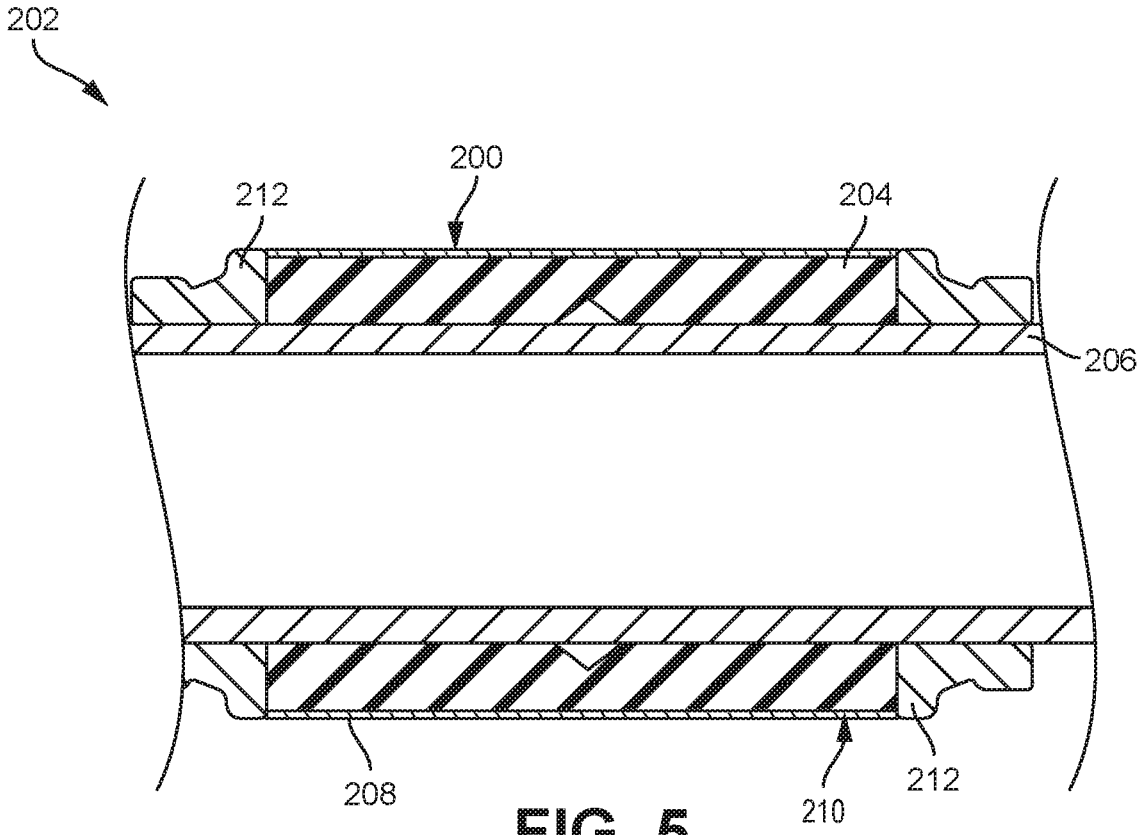
FIG. 5 is a cross-sectional side view of a plug of a seal assembly, according to one aspect.
Figure 6:
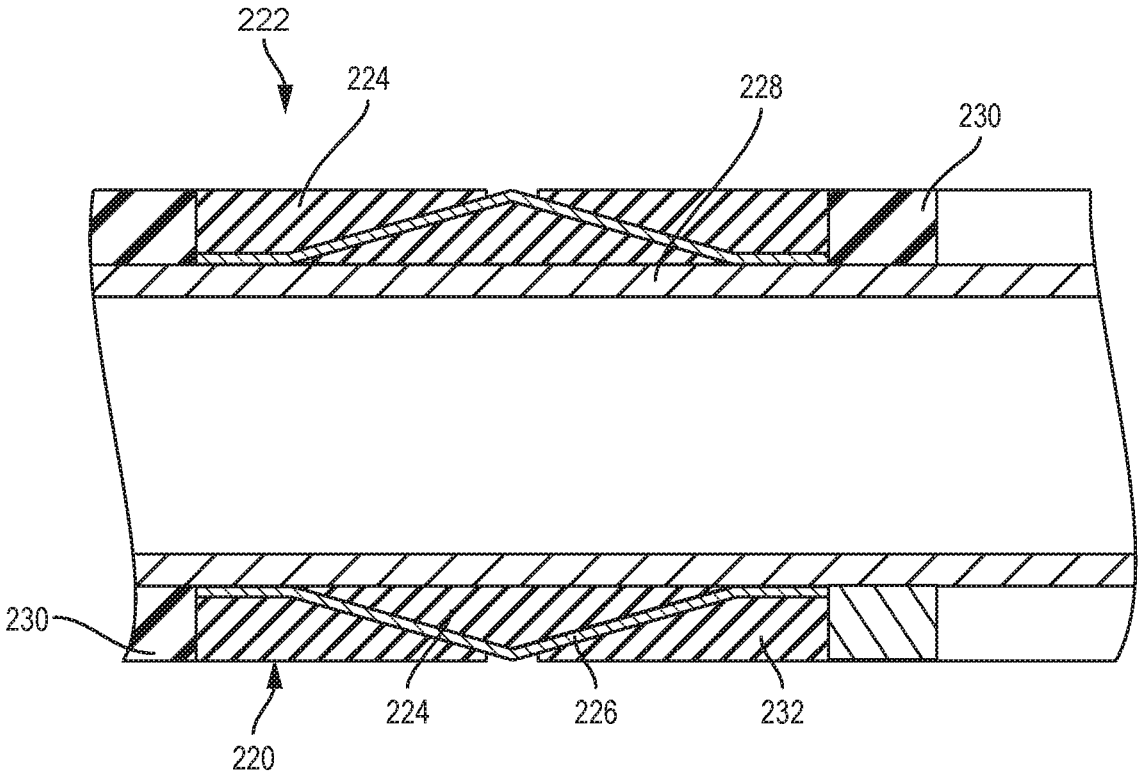
FIG. 6 is a cross-sectional side view of a plug of a seal assembly, according to another aspect.

FIG. 5 depicts a cross-sectional side view of a plug 200 of a plug assembly 202. The plug 200 includes an elastomeric material 204 that surrounds a tubing 206 of the plug assembly 202. A metal material 208 is positioned on an outer surface 210 of the elastomeric material 204. The metal material 208 may include stainless steel (e.g., 316 stainless steel annealed), a composite metal or any other suitable material. In some aspects, the metal material 208 may be a screen comprising a metal material. End caps 212 may couple the plug 200 to the tubing 206. The plug may have a circular cross section, as shown in FIG. 5, though other suitable cross-sections may be used. For example, FIG. 6 depicts a cross-sectional side view of a plug 220 of a plug assembly 222 having a triangular cross-section. The plug 220 includes an elastomeric material 224 that is surrounded by a metal material 226. The plug 220 is coupled to the tubing 228 by endcaps 230. The plug 220 is shown in FIG. 6 as having a triangular cross-section, though other suitable cross-sections may be used, for example but not limited to circular, oval, square, rectangular or other suitable shapes.

Example #1

A method of retrieving a sealing assembly from within a tubing string of a wellbore may include coupling a retrieval tool to the sealing assembly within a wellbore and extending a rod of the retrieval tool in a first direction. The sealing assembly may include a plug having a first diameter, wherein at the first diameter the plug contacts an inner surface of the tubing string.

The movement of the rod may force the plug of the sealing assembly to elongate to a second diameter, the second diameter being less than the first diameter.

Example #2

The method of Example #1 may further feature the plug comprising a non-elastomeric portion that at least partially surrounds an elastomeric portion of the plug, and wherein the non-elastomeric portion contacts the inner surface of the tubing string to form a seal at the first diameter.

Example #3

The method of any of Examples #1-2 may further feature the second diameter of the plug being substantially equal to a diameter of the plug when the sealing assembly is initially run into the wellbore.

Example #4

The method of any of Examples #1-3 may further feature, the second diameter of the plug being equal to or less than 15% greater than a diameter of the plug when the sealing assembly is initially run into the wellbore.

Example #5

The method of any of Examples #1-4, may further feature the second diameter of the plug is equal to or less than 10% greater than a diameter of the plug when the sealing assembly is initially run into the wellbore.

Example #6

The method of any of Examples #1-5 may further feature the retrieval tool comprising a mechanical latch device for coupling the retrieval tool to the sealing assembly.

Example #7

The method of Example #6 may further feature the retrieval tool being coupleable to a down-hole power unit for extending the rod in the first direction.

Example #8

The method of any of Examples #1-7 may further comprise the sealing assembly being a retrievable bridge plug.

Example #9

A tool assembly for use downhole within a tubing string may include a retrieval tool and a sealing assembly coupled to the retrieval tool at a first end of the sealing assembly. The sealing assembly may further comprise a plug having a set diameter. The retrieval tool may also comprise a rod that extends through an inner region of the sealing assembly and extends beyond the plug of the sealing assembly. The rod may be extendable in a first direction towards a second end of the sealing assembly for lengthening the plug from the set diameter to a reduced diameter that is less than the set diameter.

Example #10

The tool assembly of Example #9 may further feature the plug including a non-elastomeric material for contacting an inner surface of the tubing string at the set diameter.

Example #11

The tool assembly of Example #10, wherein plug further comprises an elastomeric material. The non-elastomeric material may at least partially surround the elastomeric material.

Example #12

The tool assembly of any of Examples #9-11 may further feature the retrieval tool comprising a mechanical latch device. The mechanical latch device may be sized and shaped to be received in a recess proximate to the first end of the sealing assembly for coupling the retrieval tool to the sealing assembly.

Example #13

The tool assembly of any of Examples #9-13 may further feature the rod of the retrieval tool being couplable to a down-hole power unit for extending the rod in the first direction.

Example #14

The tool assembly of any of Examples #9-13 may further feature the reduced diameter of the plug being substantially equal to a diameter of the plug when the sealing assembly is initially run into the tubing string.

Example #15

The tool assembly of Examples #9-14 may further feature the reduced diameter of the plug being equal to or less than 15% greater than a diameter of the plug when the sealing assembly is initially run into the tubing string.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method of retrieving a sealing assembly from within a tubing string positioned downhole within a wellbore:

coupling a retrieval tool to the sealing assembly downhole within the tubing string, the sealing assembly comprising a plug having a first diameter, wherein at the first diameter the plug contacts an inner surface of the tubing string; and extending a rod of the retrieval tool in a first direction, wherein the rod forces the plug of the sealing assembly in the first direction to elongate the plug such that the plug moves from the first diameter to a second diameter, the second diameter being less than the first diameter.

2. The method of claim 1, wherein the plug comprises a non-elastomeric portion that at least partially surrounds an elastomeric portion of the plug, and wherein the non-elastomeric portion contacts the inner surface of the tubing string to form a seal at the first diameter.

3. The method of claim 2, wherein the non-elastomeric portion of the plug comprises a metallic material for forming a metal-to-metal seal between the non-elastomeric portion of the plug and the inner surface of the tubing string when the plug is at the first diameter.

4. The method of claim 1, wherein the second diameter of the plug is substantially equal to a diameter of the plug when the sealing assembly is initially run into the wellbore.

5. The method of claim 1, wherein the second diameter of the plug is equal to or less than 15% greater than a diameter of the plug when the sealing assembly is initially run into the wellbore.

6. The method of claim 1, wherein the second diameter of the plug is equal to or less than 10% greater than a diameter of the plug when the sealing assembly is initially run into the wellbore.

7. The method of claim 1, wherein one of the retrieval tool or the sealing assembly comprises a mechanical latch device for coupling the retrieval tool to the sealing assembly.

8. The method of claim 1, wherein the retrieval tool is coupleable to a power unit for providing power to the retrieval tool for extending the rod in the first direction.

9. The method of claim 1, wherein the sealing assembly is a retrievable bridge plug.

10. The method of claim 1, wherein the retrieval tool is coupleable to a power unit for providing power to the retrieval tool for extending the rod in the first direction.

11. A tool assembly for use downhole within a tubing string comprising:

a retrieval tool; and a sealing assembly coupleable to the retrieval tool at a first end of the sealing assembly, wherein the sealing assembly further comprises a plug having a set diameter, wherein the retrieval tool comprises a rod that extends through an inner region of the sealing assembly and extends beyond the plug of the sealing assembly, wherein the rod is extendable in a first direction towards a second end of the sealing assembly for lengthening the plug from the set diameter to a reduced diameter that is less than the set diameter, and wherein one of the retrieval tool or the sealing assembly further comprises a mechanical latch device, and wherein the other of the retrieval tool or the sealing assembly further comprises a recess, wherein the mechanical latch device is sized and shaped to be received in the recess for coupling the retrieval tool to the sealing assembly.

12. The tool assembly of claim 11, wherein the plug includes a non-elastomeric portion, wherein the non-elastomeric portion contacts an inner surface of the tubing string to form a seal at the set diameter.

13. The tool assembly of claim 12, wherein the plug further comprises an elastomeric portion, wherein the non-elastomeric portion at least partially surrounds the elastomeric portion.

14. The tool assembly of claim 12, wherein the non-elastomeric portion of the plug comprises a metallic material for forming a metal-to-metal seal between the non-elastomeric portion of the plug and the inner surface of the tubing string when the plug is at the set diameter.

15. The tool assembly of claim 11, wherein the retrieval tool comprises the mechanical latch device, and wherein the sealing assembly comprises the recess, wherein the recess is positioned proximate to the first end of the sealing assembly.

16. The tool assembly of claim 11, wherein the rod of the retrieval tool may be coupled to a power unit for providing power to the retrieval tool for extending the rod in the first direction.

17. The tool assembly of claim 11, wherein the reduced diameter of the plug is substantially equal to a diameter of the plug when the sealing assembly is initially run downhole within the tubing string.

18. The tool assembly of claim 11, wherein the reduced diameter of the plug is equal to or less than 15% greater than a diameter of the plug when the sealing assembly is initially run downhole within into the tubing string.

19. A method of retrieving a sealing assembly from within a tubing string of a wellbore:

coupling a retrieval tool to the sealing assembly within the wellbore, the sealing assembly comprising a plug having a first diameter, wherein at the first diameter the plug contacts an inner surface of the tubing string; and extending a rod of the retrieval tool in a first direction, wherein the rod forces the plug of the sealing assembly in the first direction to elongate the plug such that the plug moves from the first diameter to a second diameter, the second diameter being less than the first diameter, wherein the plug comprises a metallic portion that at least partially surrounds an elastomeric portion of the plug, and wherein the metallic portion contacts the inner surface of the tubing string to form a metal-to-metal seal when the plug is at the first diameter.

20. The method of claim 19, wherein one of the retrieval tool or the sealing assembly comprises a mechanical latch device for coupling the retrieval tool to the sealing assembly.

* * * * *